US006874166B2

(12) United States Patent
Clary

(10) Patent No.: US 6,874,166 B2
(45) Date of Patent: Apr. 5, 2005

(54) NOVELTY HAT

(76) Inventor: James G. Clary, 2446 N. River Rd., P.O.Box 146, St. Clair, MI (US) 48079

( * ) Notice: Subject to any disclaimer, the term of this patent is extended or adjusted under 35 U.S.C. 154(b) by 0 days.

(21) Appl. No.: 10/112,460

(22) Filed: Mar. 29, 2002

(65) Prior Publication Data

US 2002/0162156 A1 Nov. 7, 2002

Related U.S. Application Data

(60) Provisional application No. 60/280,936, filed on Apr. 3, 2001.

(51) Int. Cl.[7] ..... A42B 1/00

(52) U.S. Cl. ..... 2/171; 446/27

(58) Field of Search ..... 2/171, 175.1, 918, 2/171.02, 183, 209.13, 195.1–195.4, 202, 206; 40/586; 446/27, 369, 372, 391; 273/DIG. 17

(56) References Cited

U.S. PATENT DOCUMENTS 2,735,109 A * 2/1956 Feldman ..... 2/172
4,268,918 A * 5/1981 Lee ..... 2/172
4,815,148 A * 3/1989 Satterfield ..... 2/195.1
4,951,319 A * 8/1990 Phillips et al. ..... 2/172
5,692,244 A * 12/1997 Johnson et al. ..... 2/181
5,781,934 A * 7/1998 Pauley, Jr. ..... 2/209.13
5,894,603 A * 4/1999 Capozzi ..... 2/171.02
D430,386 S * 9/2000 Necatera ..... D2/869

* cited by examiner

*Primary Examiner*—Katherine Moran
(74) *Attorney, Agent, or Firm*—Warn Hoffmann Miller & LaLone PC

(57) ABSTRACT

A novelty hat includes a headband with first and second end. The headband generally defines an annular shape and includes velcro closure strips on the ends thereof. At least one of the velcro strips also secures to the headband. A liner and exterior shaped figure extend upwardly from the headband. Stuffing is disposed between the liner and the figure such that the figure forms the shape of an animal head, sports logo or mascot.

7 Claims, 2 Drawing Sheets

NOVELTY HAT

CROSS-REFERENCE TO RELATED APPLICATIONS

This application claims the benefit of U.S. Provisional Application Ser. No. 60/280,936 titled NOVELTY SPORTS INSIGNIA HAT filed Apr. 3, 2001.

TECHNICAL FIELD

The present invention relates to hats. More specifically, the present invention relates to a novelty hat that includes a plush toy, preferably in the form of a realistic animal head which may or may not be a team insignia or logo.

BACKGROUND OF THE INVENTION

Logo sports hats are well known in the art. Typically, the prior logo hats include sports logos sewn on the front of the hat. Also known, are ball hats with replaceable pennant panels.

Conventional sports logo hats and ball hats with replaceable pennant panels are suitable for sports fans who want their hats to designate their favorite teams. The two-dimensional representations of logos do not stand out, particularly when viewed from a distance, and may not be easily distinguishable from other hats with two-dimensional representations of logos of other teams.

Other novelty hats include three-dimensional representations. These include U.S. Pat. No. 5,781,934 to Pauley, Jr. and U.S. Pat. No. 6,000,063 to Sullivan. These hats, typically, embody a conventional baseball hat and include three-dimensional ornamentation thereon. That is, ornamentation is secured to the conventional hat. A plush type hat is also shown in U.S. Pat. No. 5,894,603 to Capozzi. Further, each of the hats depicted in the aforementioned patents provide non-adjustable hats, or hats that are adjustable over a relatively small range of sizes. Further, none of the aforementioned patents comprise a hat wherein the hat itself is not a conventional baseball hat, but comprises a plush toy such as a rendition of an actual animal's head.

SUMMARY OF THE INVENTION

According to the present invention, there is provided a hat comprising a headband having first and second ends generally defining an annular shape to be placed around the user's head. The hat further comprises a liner extending upwardly from the headband to define a cavity for receiving a user's head. The hat further includes an exterior shaped figure extending from the headband and located exterior of the liner. The hat further comprises a closure comprising a first VELCRO hook and loop strip extending from the first end of the headband, and a second VELCRO hook and loop strip extending from the second end of the headband.

It is an object of the present invention to provide a hat that includes a shaped plush material.

It is another object of the present invention to provide a hat having a headband that can be adjustable over a relatively wide range of hat sizes.

BRIEF DESCRIPTION OF THE DRAWINGS

Other advantages and objects of the present invention will be appreciated as the same becomes better understood by reference to the following detailed description when considered in connection with the accompanying drawings wherein.

DETAILED DESCRIPTION OF THE DRAWINGS

Figure 1:
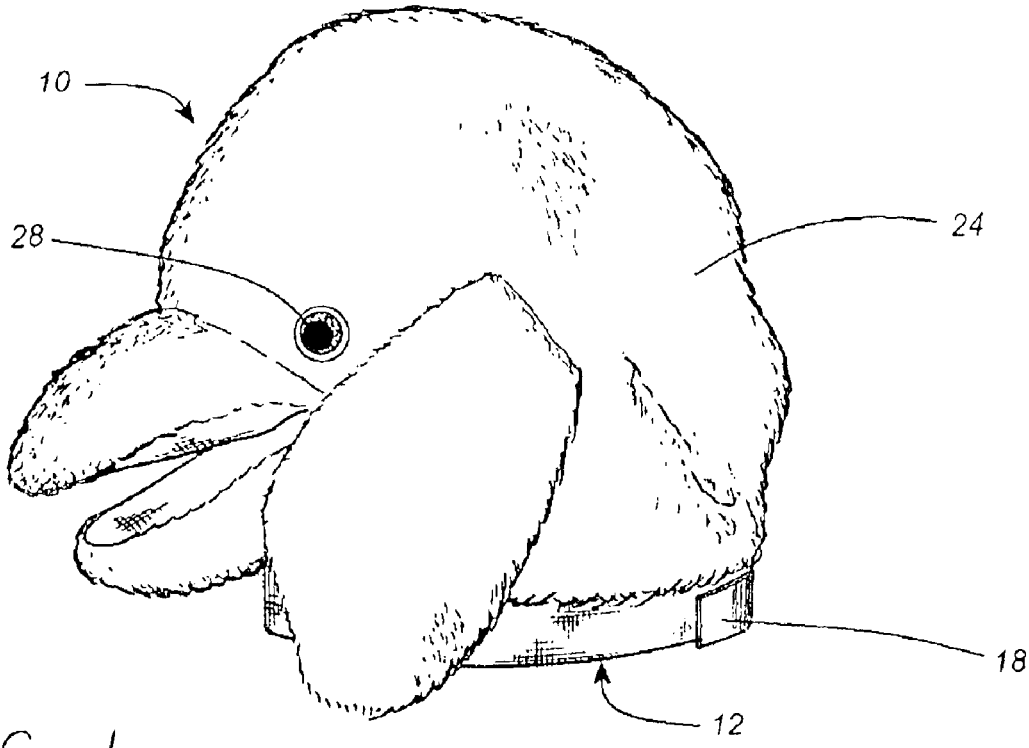
FIG. 1 is a side elevational view of a hat made in accordance with the present invention.

One embodiment of the hat made in accordance with the present invention is generally shown at 10 in the figures. The hat 10 includes a headband generally indicated at 12. The headband 12 has first 14 and second 16 ends. The headband 12 defines a generally annular shape and is adapted to be placed around a user's head. In the preferred embodiment, the headband 12 is made of a material having some elasticity. That is, the headband 12 preferably is made of a stretchable material. It is will appreciated that while the preferred embodiment includes a stretchable headband 12, a rigid headband 12 can also be used within the scope of the present invention.

VELCRO hook and loop strips 18, 20 are secured to the first 14 and second 16 ends of the headband 12, respectively. More specifically, a first VELCRO hook or loop strip 18 is secured at the first end 14 of the headband 12. Preferably, the first VELCRO hook or loop strip 18 comprises a hook-type VELCRO strip.

A second VELCRO hook or loop strip 20 is secured to the second end 16 of the headband 12. Preferably, the second VELCRO hook or loop strip 20 is the loop-type VELCRO strip. The hook-type VELCRO strip 18 secures with the loop-type VELCRO strip 20, in conventional manner to secure the headband 12.

Additionally, the headband 12 is preferably is made of a material including loops that could adhere to the hook-type VELCRO strip 18. In this manner, the VELCRO hook strip 18 can be secured to the headband 12 itself, thus rendering the headband 12 to be adjustable over a relatively wide range of sizes. The headband 12 may be made of a material that itself does not fasten to the VELCRO hook strip 18. In this embodiment, it is preferred that the headband be covered with a fabric to which the VELCRO hook or loop strip 18, 20 will secure.

The hat 10 further includes a liner 22 secured to the headband 12. The liner 22 extends upwardly from the headband 12 to form a cavity for receiving a user's head. More specifically, the liner 22 is generally configured in a dome shape to fit over a user's head. Preferably the liner 22 is of a light-weight, flexible fabric.

An exterior-shaped figure 24 extends upwardly from the headband 12 and about the exterior of the liner 22. The exterior-shaped figure 24 preferably defines the three-dimensional configuration. The figure 24 can have any configuration, but it is presently preferred that the figure 24 comprise an animal head, a sports team logo, or the like. That is, the exterior-shaped figure 24 is preferably sculpted to provide a fundamental shape such as that of the desired animal, sports team insignia or logo preferred by the user. Preferably, the exterior-shaped figure 24 is made from a soft, plush material. Additional ornamentation such as eyes 28 may be added to the figure 24 to complete the ornamentation.

In attaching the figure 24 and liner 22 to the headband 12, different methods may be used. For example, each of the figure 24 and liner 22 may independently be secured to the headband 12. Alternatively, the figure 24 and liner 22 may be secured at the base such as by sewing, and then the combination may be secured such as by sewing to the headband 12.

Figure 2:
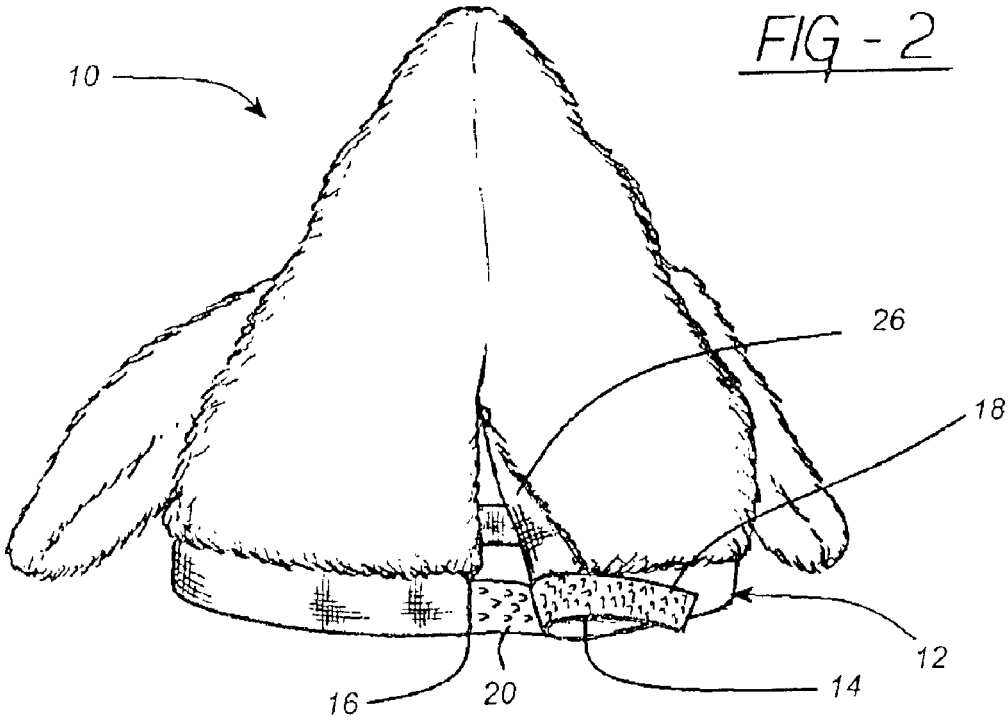
FIG. 2 is a rear elevational view of the hat of FIG. 1.
Figure 3:
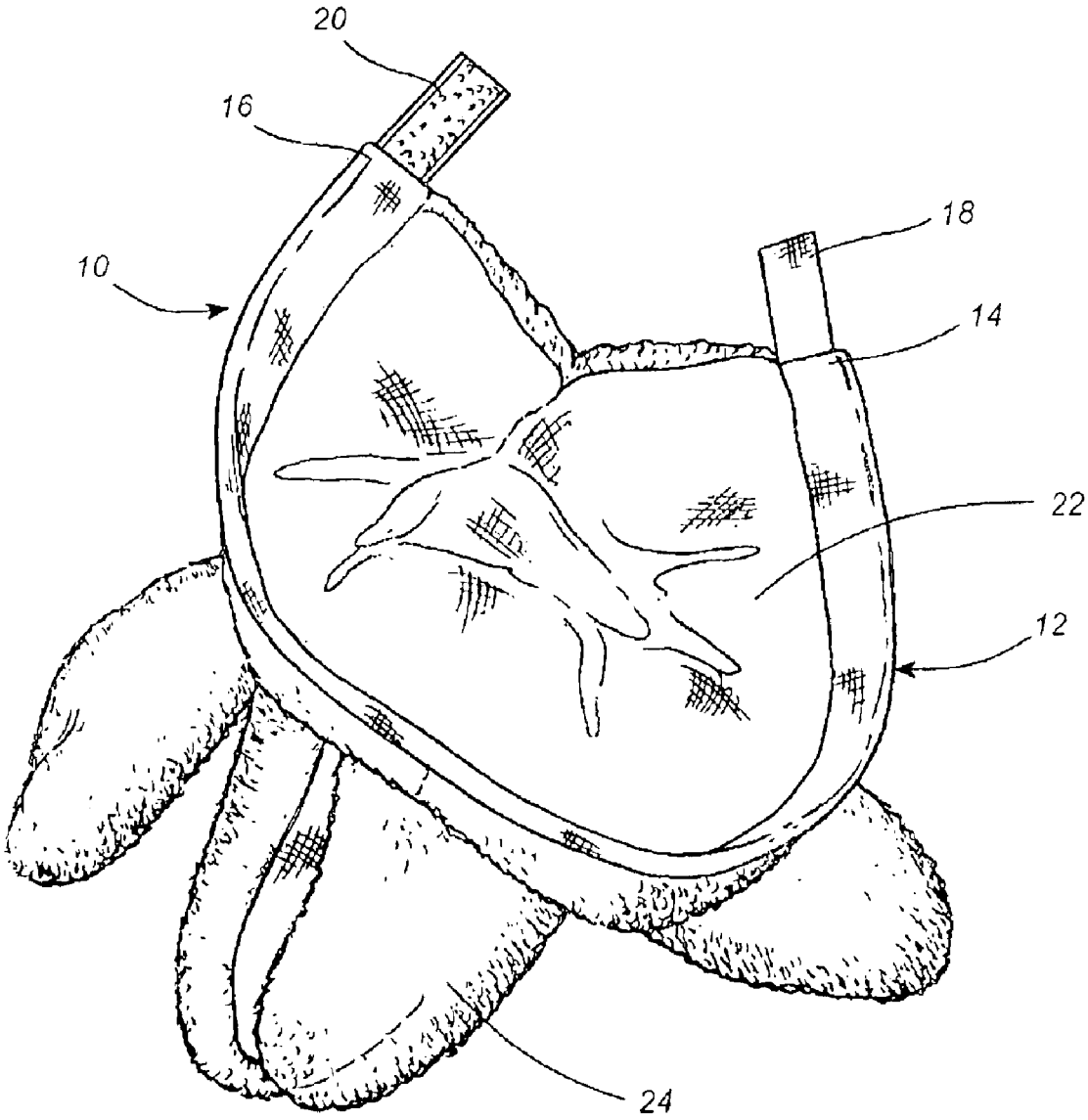
FIG. 3 is bottom perspective view of the hat of FIG. 1.

Also, the liner 22 and figure 24 each have a slit 26 therein. The slit 26 extends from the headband 12 upwardly a distance. The distance may vary depending on the length of the slit desired and the amount of adjustability desired in the hat 10. More specifically, the slit 26 is created as the figure 24 and liner 22 preferably attach only to the headband 12 and not to the VELCRO hook and loon strips 18, 20. As best seen in FIG. 2, the slit 26 creates an adjustable opening between adjacent ends of the headband 12.

Finally, the hat 10 may include a stuffing between the liner 22 and figure 24. The stuffing provides necessary support for creating the 24. The stuffing can be in areas necessary to create the requisite ornamentation. Preferably, the stuffing is lightweight but provides adequate support between the liner 22 and figure 24 to maintain the desired shape of the figure 24.

The invention has been described in an illustrative manner as to be understood that the terminology which has been used is intended to be in the nature of words of description rather than of limitation. Obviously, many modifications and variations of the present invention are possible in light of the above teachings. It is, therefore, to be understood that the invention may be practiced otherwise as is specifically described.

What is claimed is:

1. A hat comprising:

a headband having first and second ends and generally defining an annular shape to be placed around a user's head;

a liner extending upwardly from said headband to define a cavity therein for receiving a user's head;

an exterior shaped figure extending from said headband and exterior of said liner;

a stuffing material disposed between said liner and said exterior shaped figure; and a closure comprising a first hook strip extending from said first end of said headband and a second loop strip extending from said second end of said headband, at least one of said hook and said loop strips adapted to secure said headband around the user's head.

2. A hat as set forth in claim 1 wherein one of said hook and said loop strip is adapted to cooperate with said headband.

3. A hat as set forth in claim 2 wherein said headband includes a material that is adapted to be secured to one of said hook and loop strips.

4. A hat as set forth in claim 2 wherein said headband is stretchable.

5. A hat as set forth in claim 4 wherein each of said liner and said exterior shaped figure include a slit.

6. A hat as set forth in claim 5 wherein said exterior shaped figure comprises an animal's head.

7. A hat as set forth in claim 5 wherein said exterior shaped figure comprises a sports insignia.

* * * * *